US006679385B2

(12) United States Patent
Suter et al.

(10) Patent No.: US 6,679,385 B2
(45) Date of Patent: Jan. 20, 2004

(54) MOTOR CONTROL SYSTEM FOR VIBRATING SCREEN SEPARATOR

(75) Inventors: Roger Suter, Missouri City, TX (US); Alan Burkhard, Houston, TX (US)

(73) Assignee: M I LLC., Houston, TX (US)

( * ) Notice: Subject to any disclaimer, the term of this patent is extended or adjusted under 35 U.S.C. 154(b) by 0 days.

(21) Appl. No.: 10/044,681

(22) Filed: Jan. 11, 2002

(65) Prior Publication Data

US 2002/0153288 A1 Oct. 24, 2002

Related U.S. Application Data

(63) Continuation-in-part of application No. 09/837,098, filed on Apr. 18, 2001.

(51) Int. Cl.[7] ..... B07B 1/44

(52) U.S. Cl. ..... 209/367; 209/365.4; 209/366; 209/366.5

(58) Field of Search ..... 209/367, 365.4, 209/366, 366.5

(56) References Cited

U.S. PATENT DOCUMENTS

| | | | | |
|---|---|---|---|---|
| 3,716,967 A | | 2/1973 | Doyle, Jr. et al. | |
| 3,831,352 A | | 8/1974 | Parcels | |
| 4,272,258 A | | 6/1981 | Shifflett | |
| 4,387,514 A | | 6/1983 | McCaskill, Jr. | |
| 4,634,535 A | | 1/1987 | Lott | |
| 4,750,845 A | * | 6/1988 | Nabetani | 366/208 |
| 4,872,949 A | | 10/1989 | Wilwerding | |
| 4,990,130 A | * | 2/1991 | Prais | 494/20 |
| 5,035,601 A | * | 7/1991 | Lin | 425/429 |
| 5,188,041 A | | 2/1993 | Noland et al. | |
| 5,427,451 A | * | 6/1995 | Schmidt | 366/208 |
| 5,458,416 A | * | 10/1995 | Edwards et al. | 366/209 |
| 5,570,749 A | | 11/1996 | Reed | |
| 5,655,836 A | * | 8/1997 | Preston et al. | 366/208 |
| 5,896,998 A | * | 4/1999 | Bjorklund et al. | 209/326 |
| 6,200,428 B1 | | 3/2001 | VanKouwenberg | |
| 6,349,834 B1 | * | 2/2002 | Carr et al. | 209/366.5 |
| 6,516,679 B2 | * | 2/2003 | Yates et al. | 74/87 |

* cited by examiner

*Primary Examiner*—Donald P. Walsh
*Assistant Examiner*—Jonathan R Miller
(74) *Attorney, Agent, or Firm*—Howrey Simon Arnold & White LLP

(57) ABSTRACT

A vibrating screen separator. The vibrating screen separator may be operated in a linear, an elliptical, or in a transition from elliptical to linear modes of operation. In the linear mode of operation, the screen separator moves along a reciprocating straight line path, and, in the elliptical mode of operation, the screen separator moves along an elliptical path. In the transitionary mode of operation, the screen separator is transitioned from movement along the elliptical path to movement along the linear path.

28 Claims, 14 Drawing Sheets

MOTOR CONTROL SYSTEM FOR VIBRATING SCREEN SEPARATOR

CROSS REFERENCE TO RELATED APPLICATIONS

This application is a continuation-in-part of U.S. utility patent application Ser. No. 09/837,098, filed on Apr. 18, 2001, the disclosure of which is incorporated herein by reference.

This invention relates generally to a screen separator, and in particular to a vibrating screen separator.

BRIEF DESCRIPTION OF THE DRAWINGS

FIGS. 1*aa*, 1*ab*, 1*ac*, and 1*ad* are isometric, top, side, and front views, respectively, of an embodiment of a vibrating screen separator assembly.

DESCRIPTION OF THE PREFERRED EMBODIMENTS

Figure 1A:
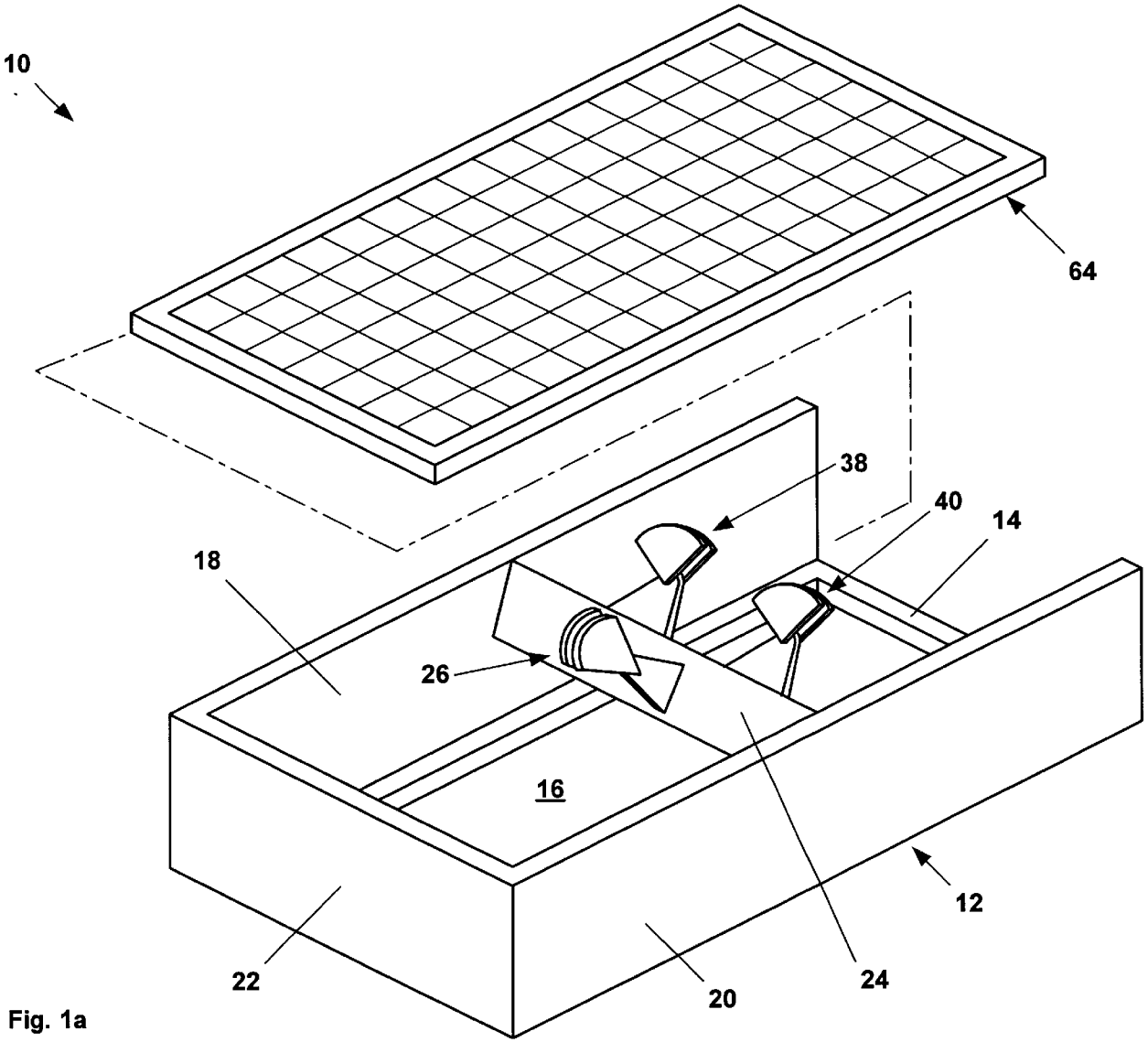
FIG. 1*a* is a conceptual isometric view of an embodiment of a vibrating screen separator assembly.
Figure 1A:
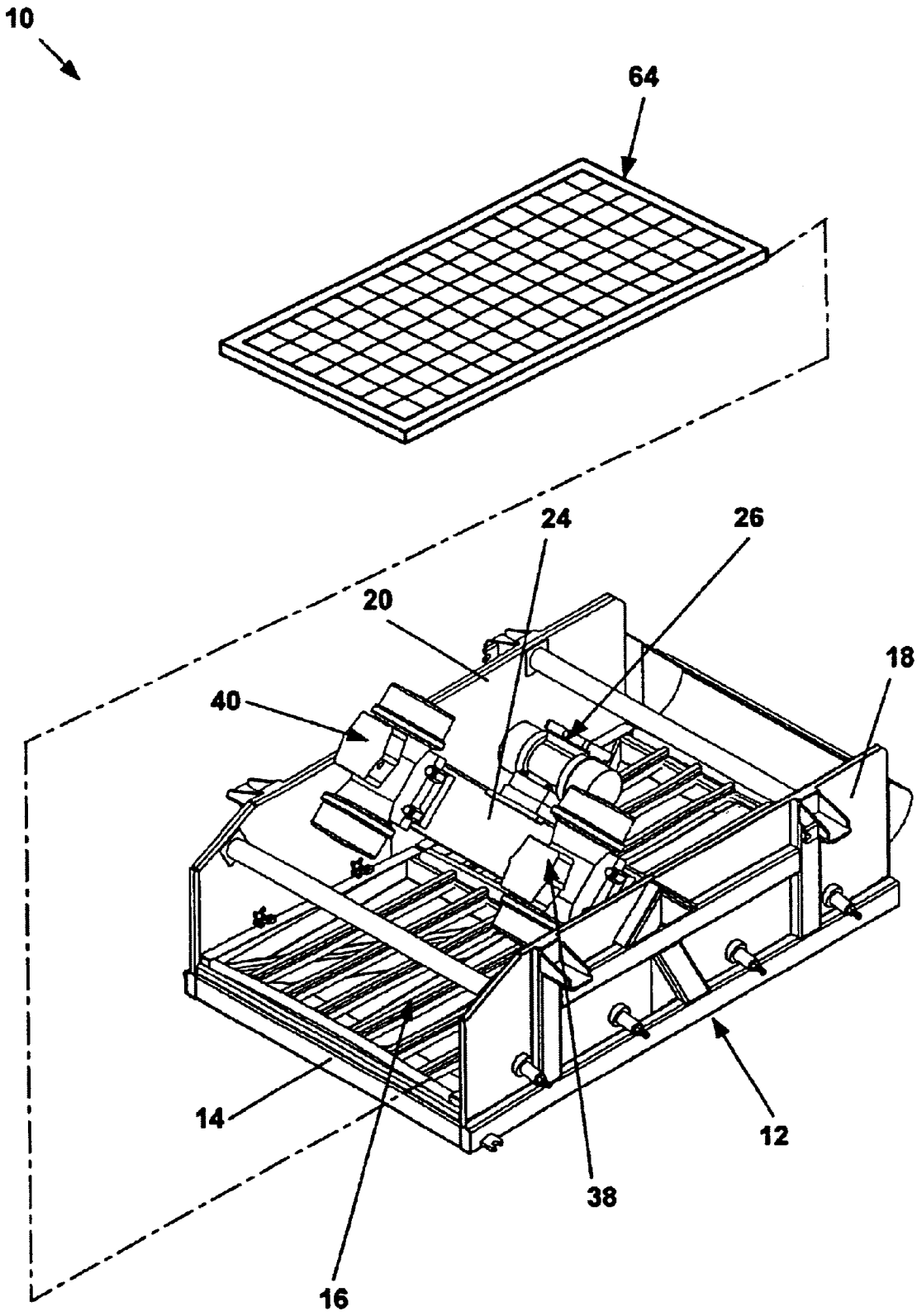
Figure 1A:
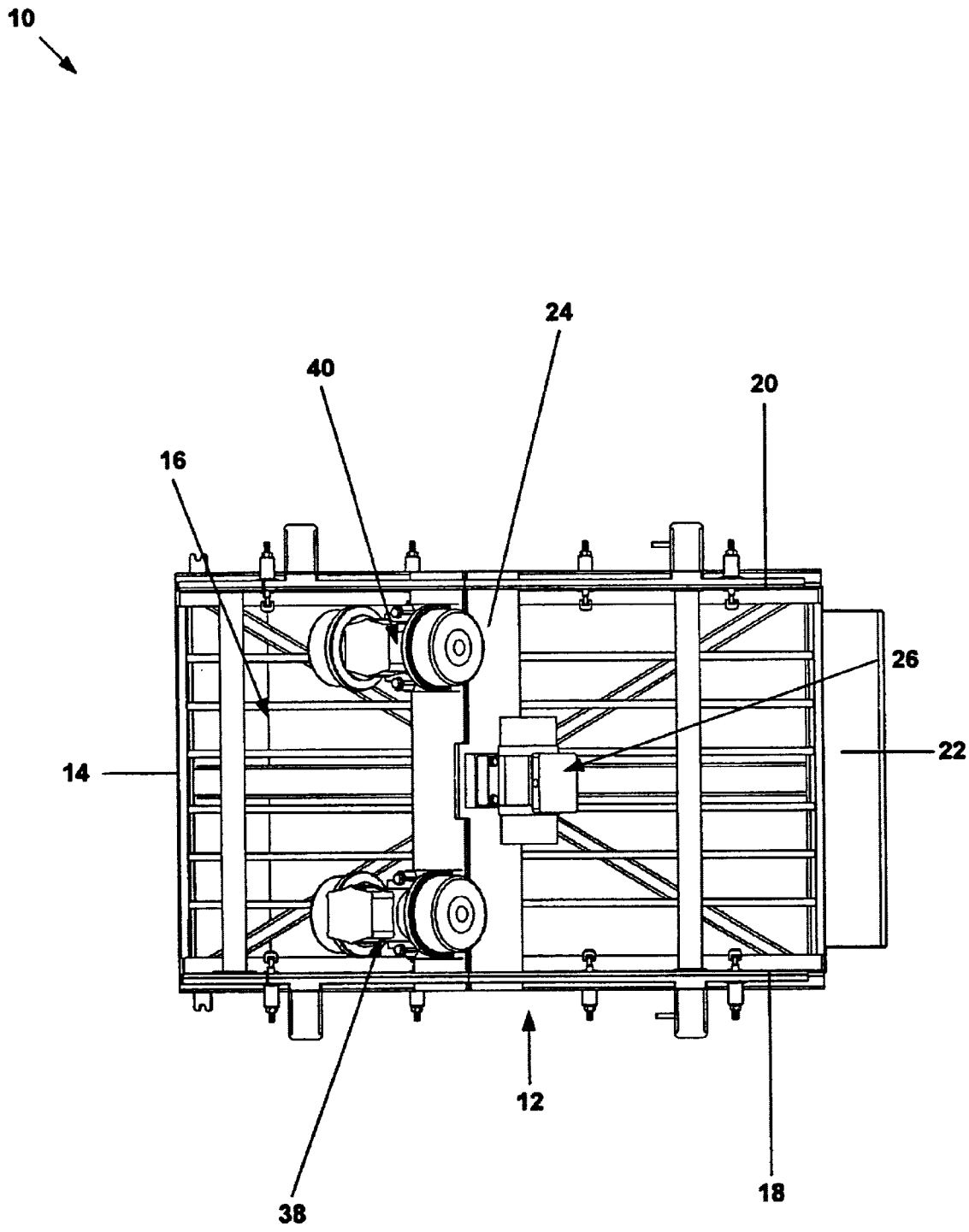
Figure 1A:
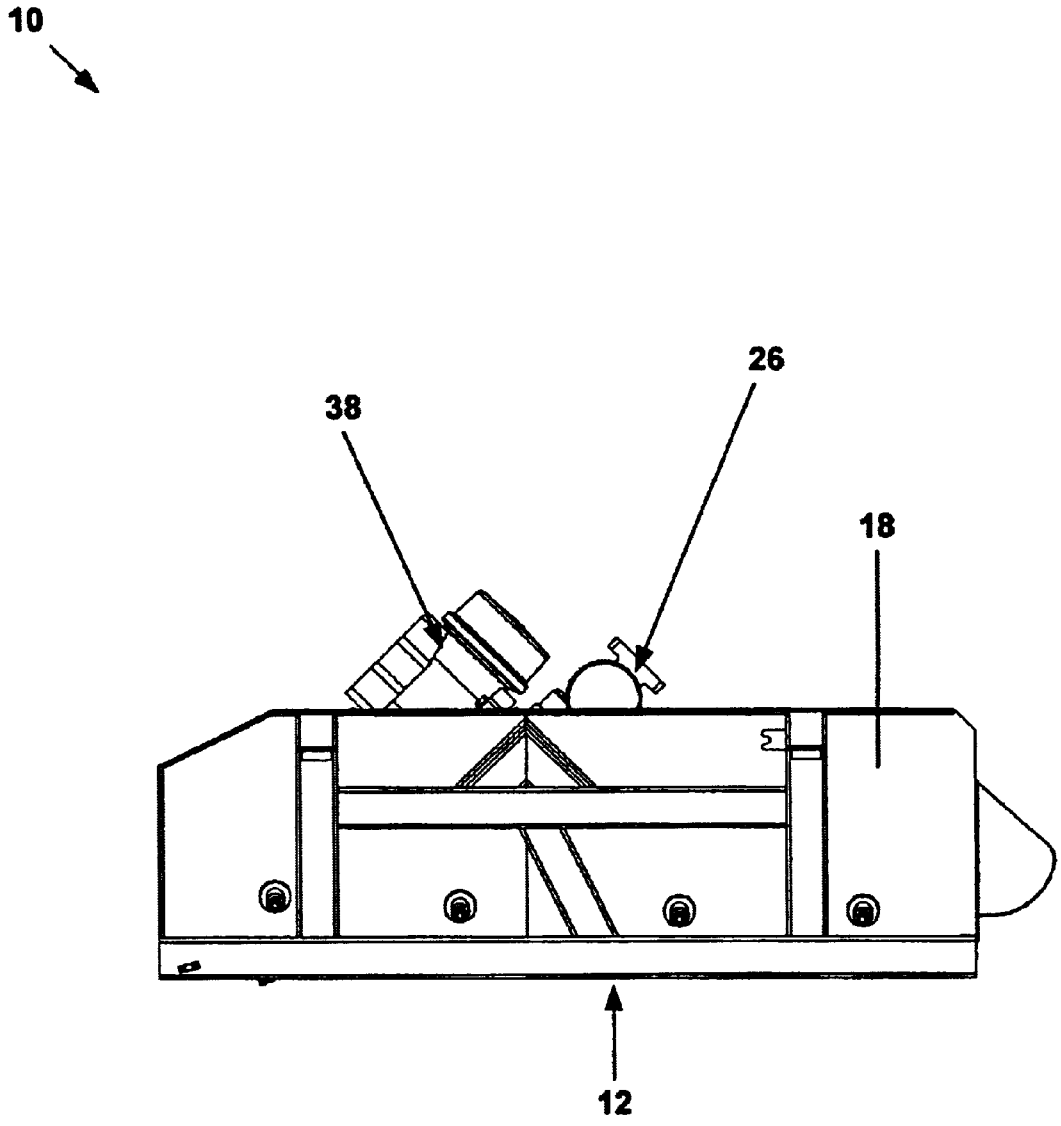
Figure 1A:
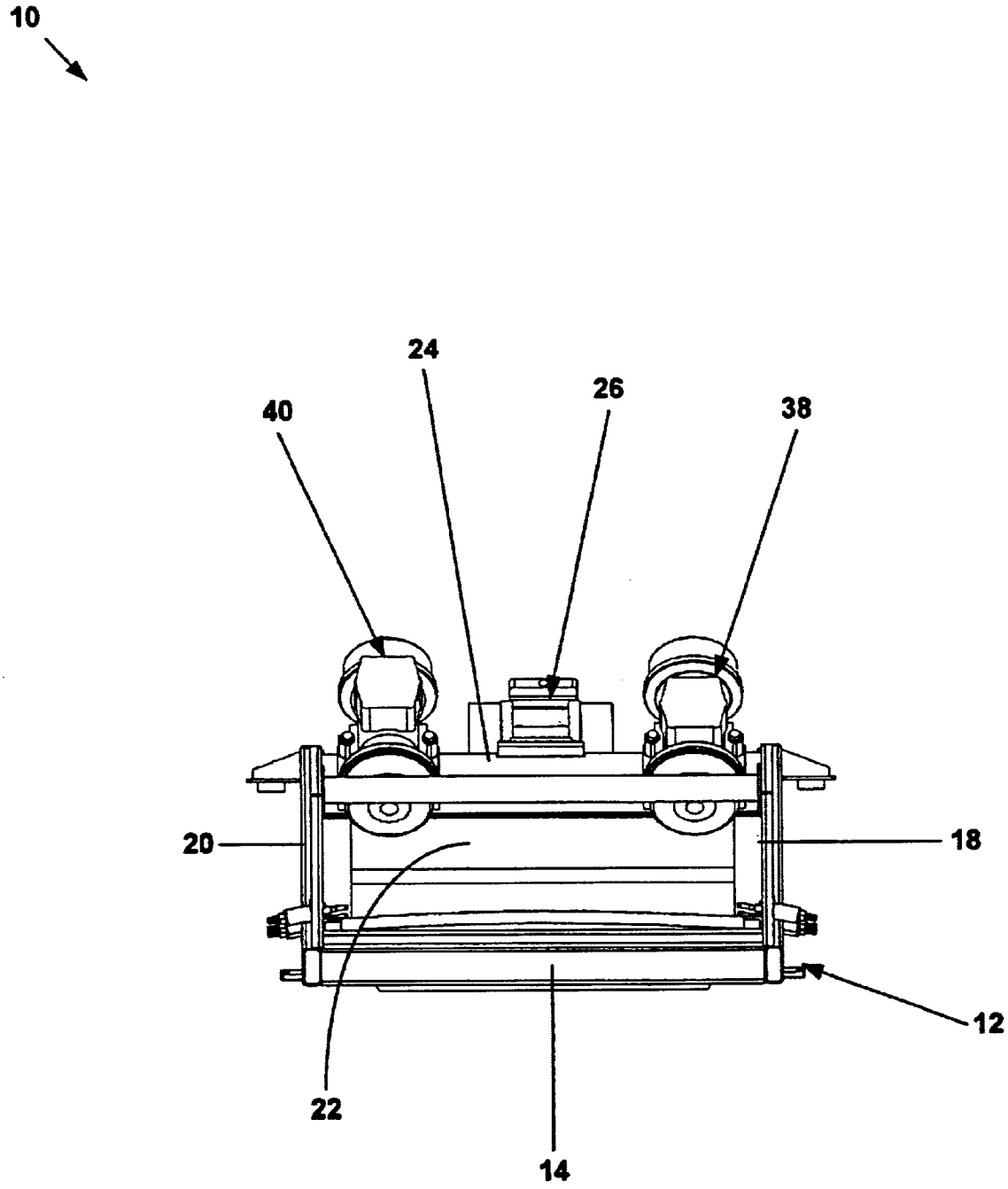
Figure 1B:
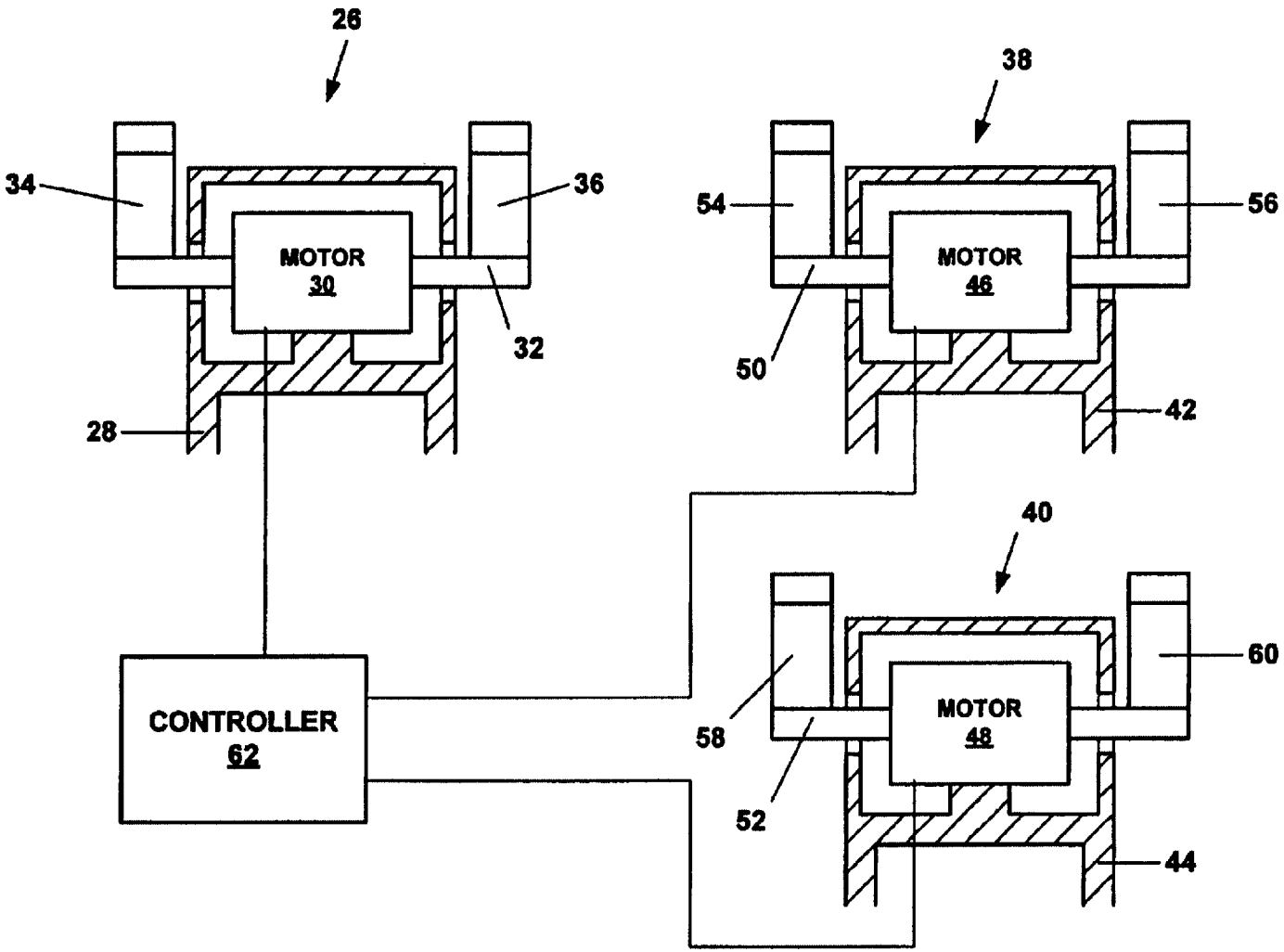

Referring to FIGS. 1*a*, 1*aa*, 1*ab*, 1*ac*, 1*ad*, and 1*b*, the reference numeral 10 refers, in general, to a vibrating screen separator assembly that includes a frame, or bed, 12 that includes a bottom wall 14 having an opening 16, a pair of side walls, 18 and 20, an end wall 22, and a crops support member 24 coupled between the side walls. An actuator 26 for imparting motion to the frame 12 is coupled to the support member 24 that includes a housing 28 that is coupled to the support member that supports and is coupled to a rotary motor 30 having a rotary shaft 32 having opposite ends that extend out of the housing. A pair of substantially identical unbalanced weights, 34 and 36, are coupled to the opposite ends of the rotary shaft 30.

Actuators, 38 and 40, respectively, for imparting motion to the frame 12 are also coupled to the support member 24 that include housings, 42 and 44, respectively, that are coupled to the support member that support and are coupled to rotary motors, 46 and 48, respectively, having rotary shafts, 50 and 52, respectively, having opposite ends that extend out of the housings. Pairs of substantially identical unbalanced weights, 54 and 56 and 58 and 60, respectively, are coupled to the opposite ends of the rotary shafts, 50 and 52, respectively. In an exemplary embodiment, the rotary shafts, 50 and 52, are substantially parallel and perpendicular to a common plane, and the size, shape and mass of the unbalanced weights, 54, 56, 58, and 60 are substantially identical.

In an exemplary embodiment, the rotary shaft 32 is perpendicular to a different plane than the rotary shafts, 50 and 52.

The rotary motors, 30, 46 and 48, are operably coupled to a controller 62 that provides motive power and controls the operation of the rotary motors. A screen 64 is received within the frame 12 and is adapted to be rigidly coupled to the bottom wall 14 using conventional mechanical fasteners.

Figure 2:
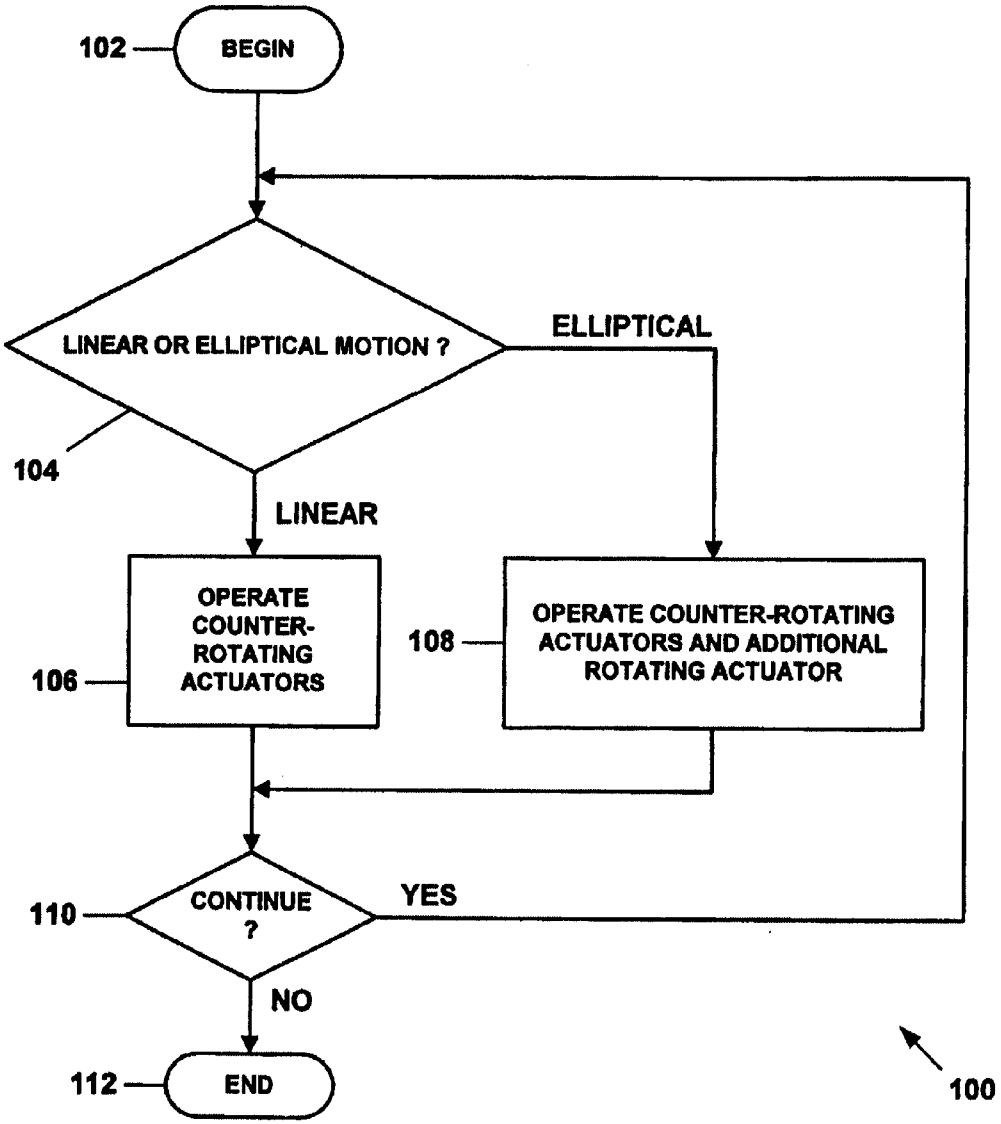
FIG. 2 is a flow chart that illustrates an embodiment of the operation of the assembly of FIGS. 1*a* and 1*b*.

During operation of the assembly 10, as illustrated in FIG. 2, the controller 62 may implement a motion control program 100 in which a user may initiate operation of the assembly in step 102. The user may then select linear or elliptical movement to be imparted to the frame 12 of the assembly 10 in step 104.

Figure 3A:
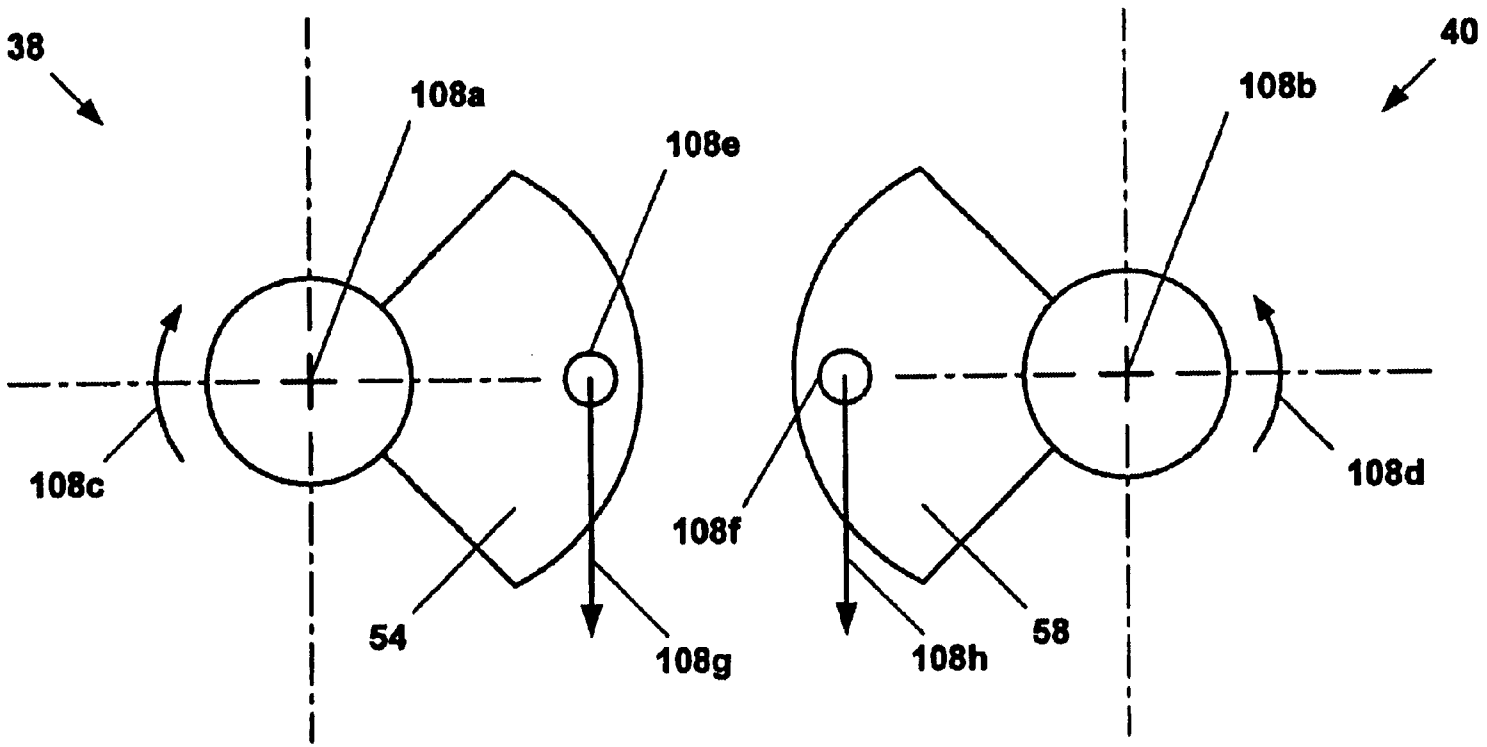
FIG. 3*a* is a side view of the operation of the counter-rotating actuators of the assembly of FIGS. 1*a* and 1*b*.

If the user selects linear motion in step 104, then the controller may operate the actuators, 38 and 40, for imparting motion to the frame 12 in step 106. As illustrated in FIG. 3*a*, during operation of the actuators, 38 and 40, for imparting motion to the frame 12, the unbalanced weights, 54 and 58, are rotated by the motors, 46 and 48, respectively, about axes of rotation, 108*a* and 108*b*, respectively, in opposite directions, 108*c* and 108*d*, respectively, at substantially the same rotational speed with the rotational positions of the centers of mass, 108*e* and 108*f*, substantially mirror images of one another. The rotation of the unbalanced weights, 54 and 58, about the axes of rotation, 108*a* and 108*b*, produces centrifugal forces, 108*g* and 108*h*, respectively, that are directed from the centers of mass, 108*e* and 108*f*, respectively, of the unbalanced weights, 54 and 58, respectively, in the directions normal to the vectors from the centers of rotation to the corresponding centers of mass.

Figure 3B:
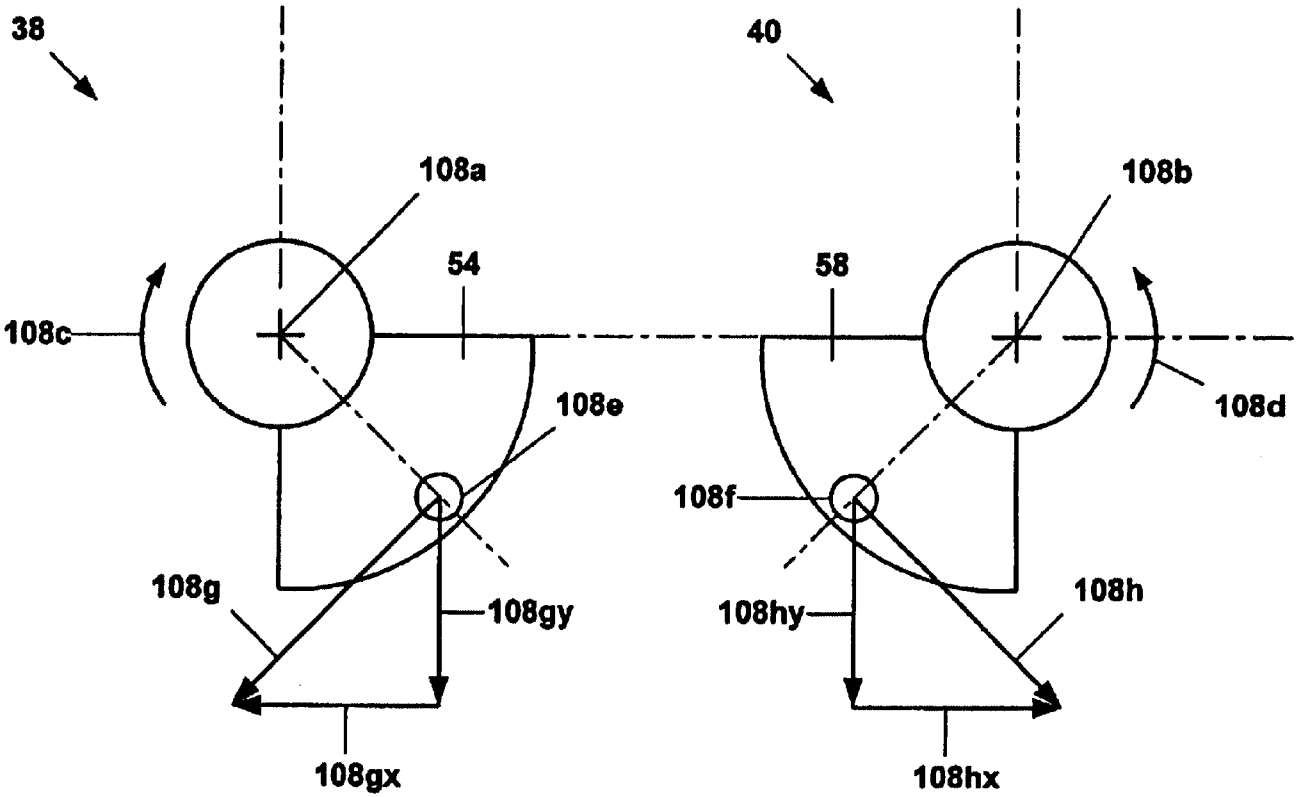
FIG. 3*b* is a schematic illustration of the forces imparted to the frame of the assembly of FIGS. 1*a* and 1*b* during the operation of the counter-rotating actuators.

The resulting centrifugal forces, 108*g* and 108*h*, created during the rotation of the rotation of the unbalanced weights, 54 and 58, about the axes of rotation, 108*a* and 108*b*, impart a reciprocal linear motion to the frame 12 of the assembly 10. In particular, as illustrated in FIG. 3*b*, the centrifugal forces, 108*g* and 108*h*, include horizontal components, 108*gx* and 108*hx*, respectively, and vertical components, 108*gy* and 108*hy*, respectively. Because, the direction and speed of rotation of the unbalanced weights, 54 and 58, are opposite and equal, the horizontal components, 108*gx* and 108*hx*, cancel each other out. As a result, the only forces acting on the frame 12 of the assembly due to the rotation of the unbalanced weights, 54 and 58, about the axes of rotation, 108*a* and 108*b*, are the sum of the vertical forces, 108*gy* and 108*hy*. Since the vertical forces, 108*gy* and 108*hy*, vary from a positive maximum vertical force to a negative maximum vertical force during the rotation of the unbalanced weights, 54 and 58, about the axes of rotation, 108*a* and 108*b*, the resulting linear motion imparted to the frame 12 of the assembly is a reciprocating linear motion. Thus, the combination of the actuators, 38 and 40, provides an actuator for imparting linear motion to the frame 12 of the assembly. In an exemplary embodiment, during operation, the rotational positions and centrifugal forces created during the rotation of the unbalanced weights, 54 and 56 and 58 and 60, about the axes of rotation, 108*a* and 108*b*, respectively, are substantially identical.

If the user selects elliptical motion in step 104, then the controller may simultaneously operate the actuator 26 for imparting motion to the frame 12 and the actuators, 38 and 40, for imparting motion to the frame in step 108.

Figure 4:
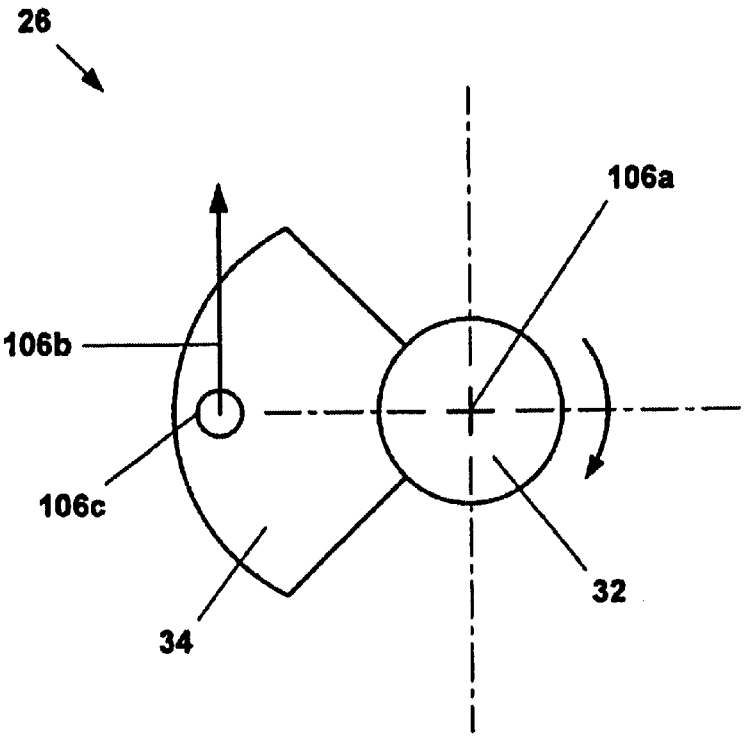
FIG. 4 is a side view of the operation of the additional rotating actuator of the assembly of FIGS. 1*a* and 1*b*.

As illustrated in FIG. 4, during operation of the actuator 26 for imparting motion to the frame 12, the unbalanced weight 34 is rotated by the motor 30 about an axis of rotation 106*a*. The rotation of the unbalanced weight 34 about the axis of rotation 106*a* produces a centrifugal force 106*b* that is directed from the center of mass 106*c* of the unbalanced weight 34 in the direction normal to the vector from the center of rotation to the center of mass. In an exemplary embodiment, during step 108, the rotational positions, speeds, and centrifugal forces created during the rotation of the unbalanced weights, 34 and 36, about the axis of rotation 106*c* are substantially identical. The resulting centrifugal forces created during the rotation of the rotation of the unbalanced weights, 34 and 36, about the axis of rotation 106*c* would impart a circular motion to the frame 12 of the assembly 10 if the actuator 26 were operated alone.

Because the rotary shaft 32 of the actuator 26 is perpendicular to a different plane than the rotary shafts, 50 and 52, of the actuators, 38 and 40, the simultaneous operation of the actuators, and the forces that are generated, as described above, results in elliptical motion being imparted to the frame 12 of the assembly 10. Thus, the combination of the actuators, 26, 38 and 40, provides an actuator for imparting elliptical motion to the frame 12.

If the user elects to discontinue the operation of the program 100 in step 110, then the operation of the program ends in step 112.

In an exemplary embodiment, during the operation of the assembly 10 using the motion control program 100, fluidic material including solid particles is injected onto the screen 64. In an exemplary embodiment, the injection of the fluidic material onto the screen 64 is provided substantially as described in U.S. patent application Ser. No. 09/836,974, attorney docket number 20773.35, filed on Apr. 18, 2001, the disclosure of which is incorporated herein by reference. In this manner, the separation of solid particles from the liquids within the fluidic material is enhanced by the motion imparted to the frame 12 and screen 64. In an exemplary embodiment, movement of the frame 12 and screen 64 along an elliptical path maintains solid particles on the screen for a longer period of time thereby permitting more liquids to be extracted from the fluidic material thereby providing a drier solid particle discard.

Figure 5:
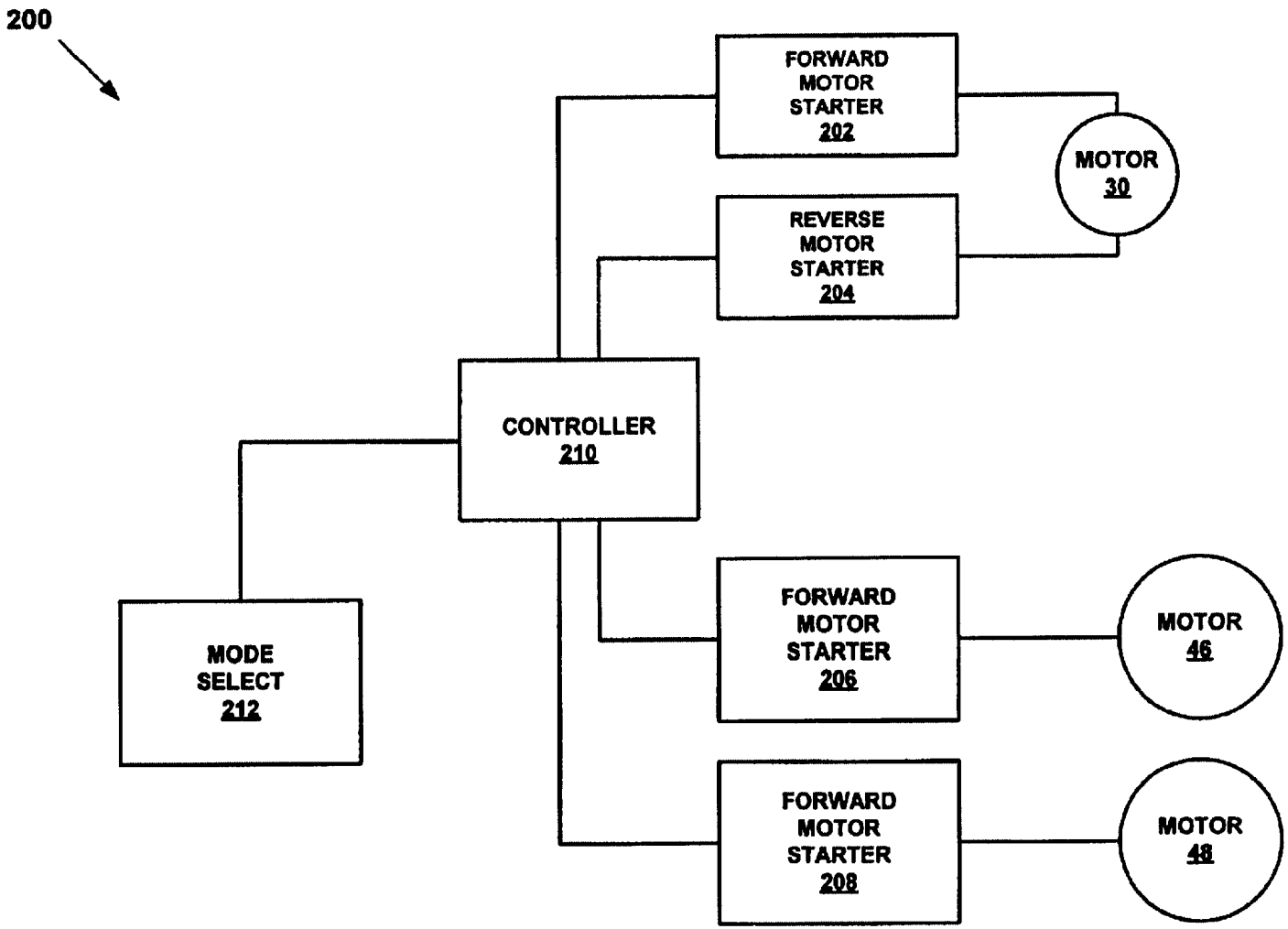
FIG. 5 is a schematic illustration of an embodiment of a control system for controlling the operation of the assembly of FIGS. 1*a* and 1*b*.

Referring to FIG. 5, an embodiment of a control system 200 for controlling the operation of the motors, 30, 46, and 48, of the vibrating screen separator assembly 10 includes a forward motor starter 202 and a reverse motor starter 204 that are operably coupled to the motor 30, a forward motor starter 206 that is operably coupled to the motor 46, and a forward motor starter 208 that is operably coupled to the motor 48. As will be recognized by persons having ordinary skill in the art, motor starters may be used to initiate the operation and rotation of an output shaft of a motor in a predetermined direction by causing the windings of the motor to apply a torque to the output shaft of the motor. A controller 210 is operably coupled to the forward motor starter 202, the reverse motor starter 204, the forward motor starter 206, and the forward motor starter 208 for controlling the operation of the forward and reverse motor starters, and a mode select 212 is operably coupled to the controller 210 for permitting a user to select the mode of operation of the control system 200.

Figure 6A:
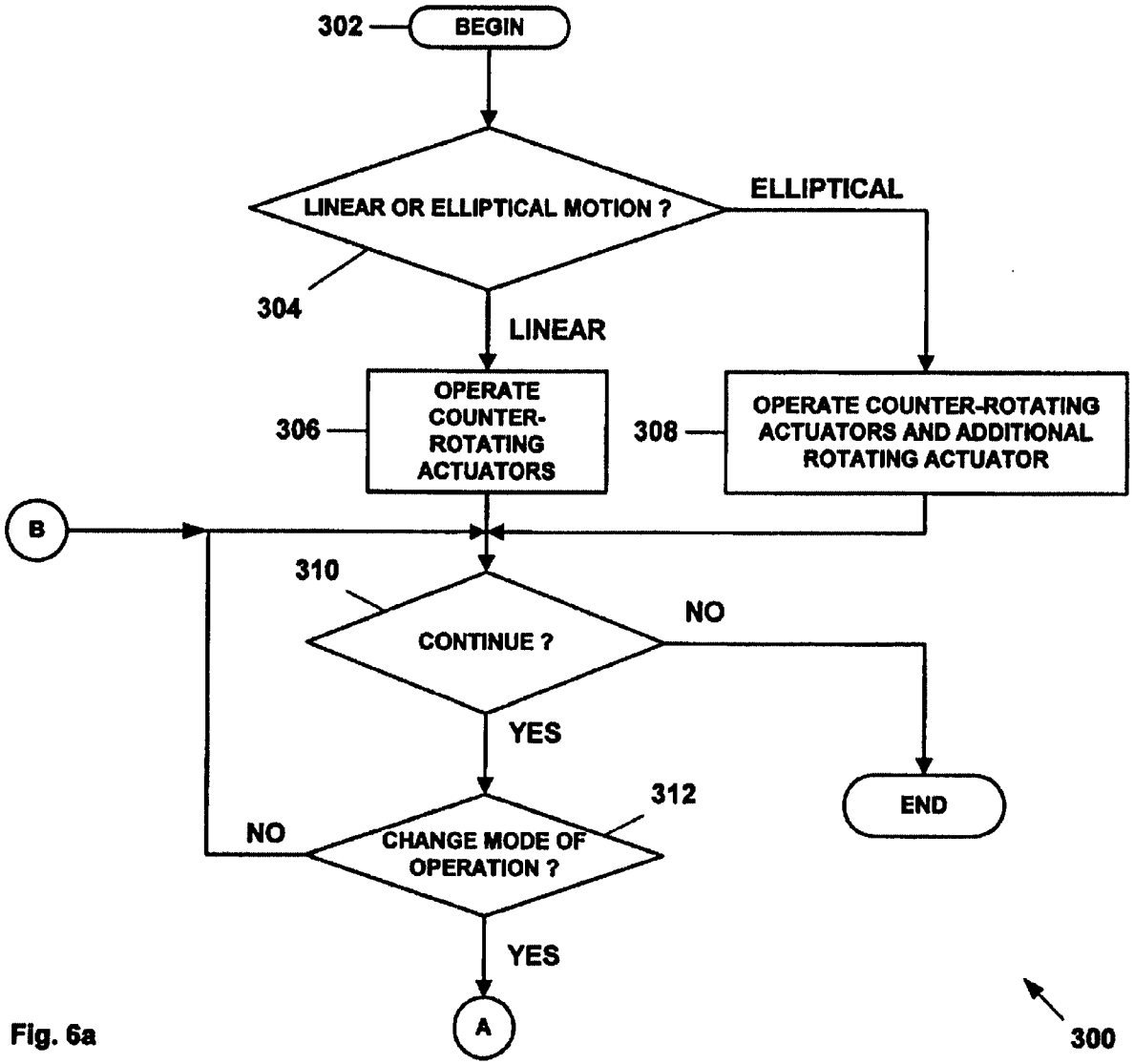
FIGS. 6*a*–6*c* is a flow chart that illustrates an embodiment of the operation of the control system of FIG. 5.
Figure 6B:
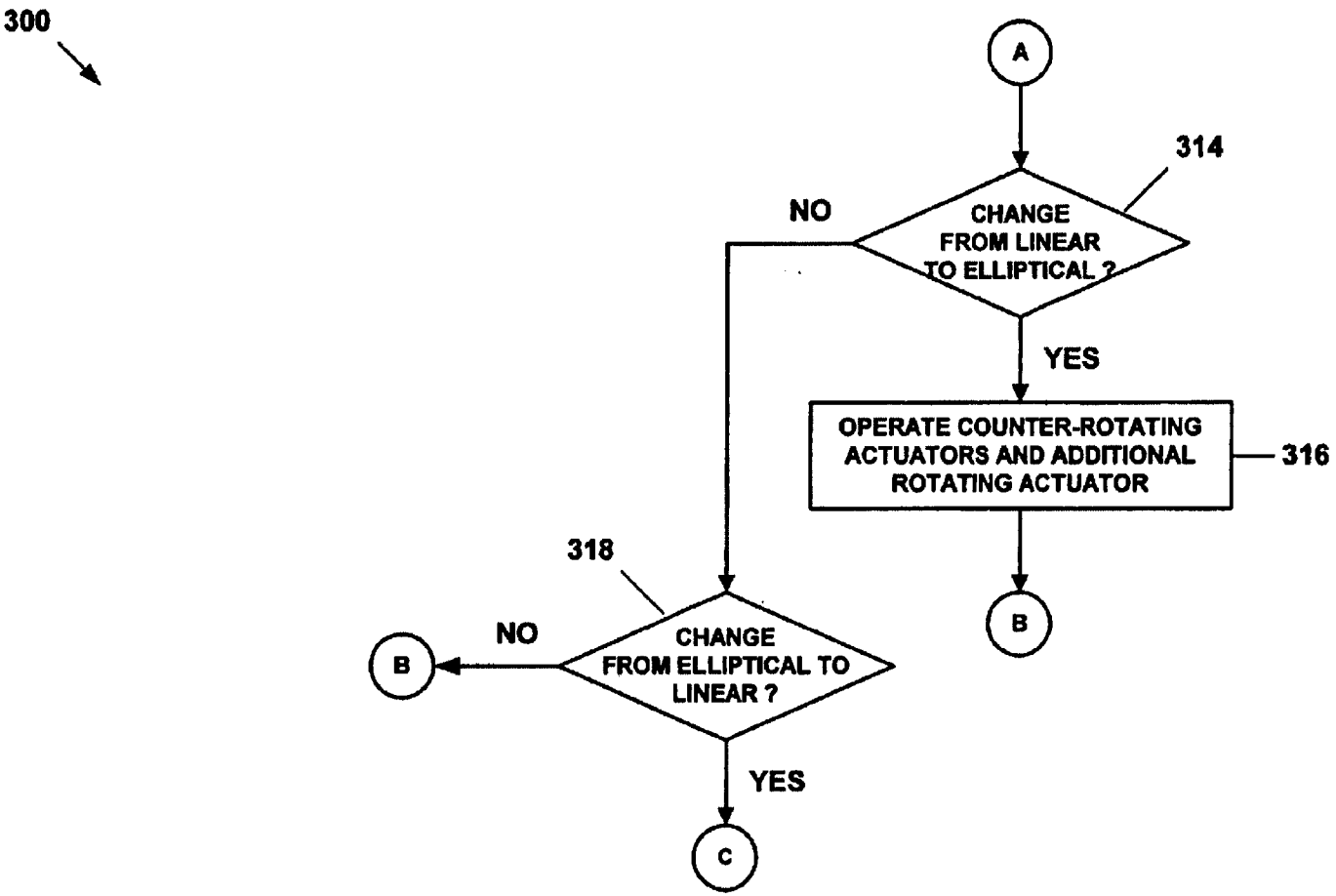
Figure 6C:
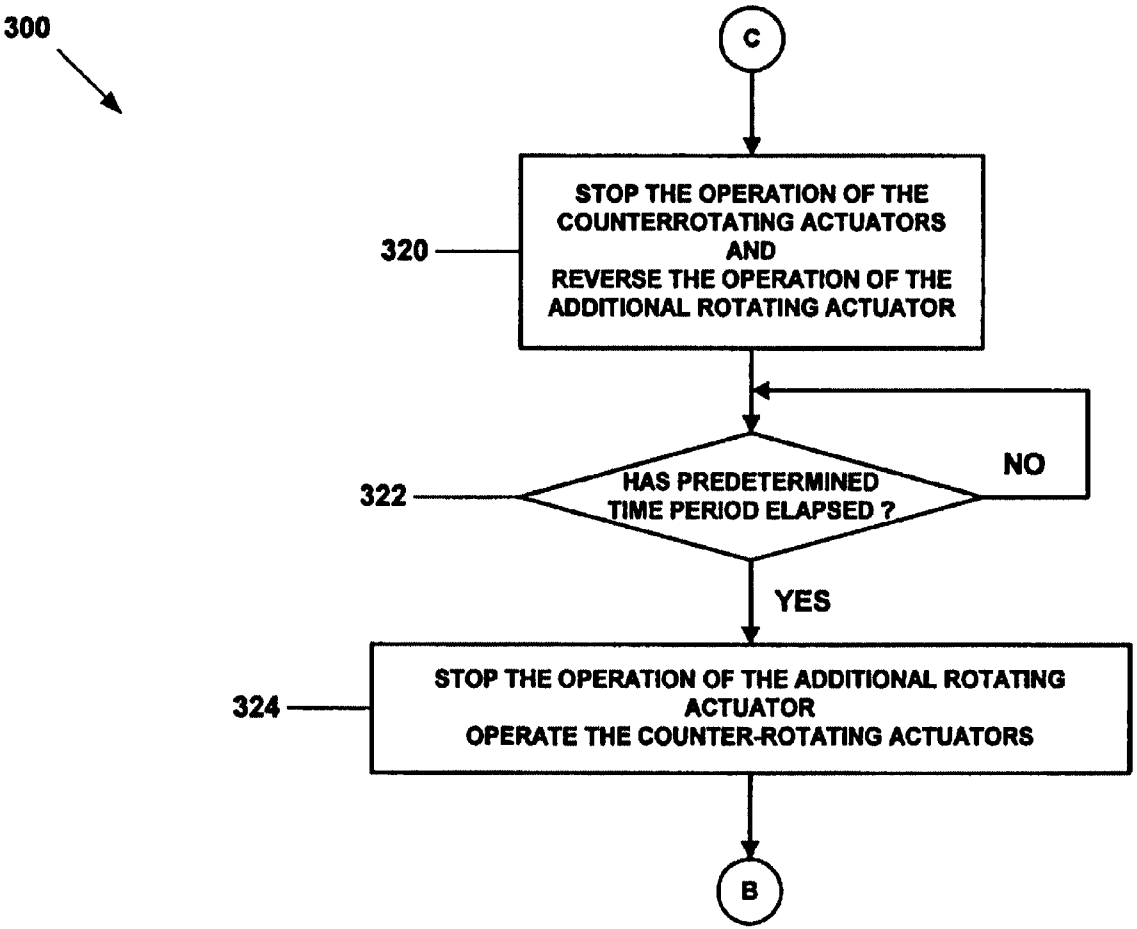

During operation of the control system 200, as illustrated in FIGS. 6*a*–6*c*, the controller 210 may implement a motion control program 300 in which a user may initiate operation of the control system in step 302. The user may then select linear or elliptical movement to be imparted to the frame 12 of the assembly 10 in step 304.

If the user selects linear motion in step 304, then the controller 210 may operate the motors 46 and 48 to impart linear motion to the frame 12 of the assembly 10 in step 306. In particular, in step 306, the controller 210 may operate the forward motor starters, 206 and 208, to operate the motors, 46 and 48, respectively, in equal and opposite directions of rotation to impart linear motion to the frame 12 of the assembly 10. Alternatively, If the user selects elliptical motion in step 304, then the controller 210 may operate the motors 30, 46, and 48 to impart elliptical motion to the frame 12 of the assembly 10 in step 308. In particular, in step 308, the controller 210 may operate the forward motor starters, 202, 206, and 208, to operate the motor 30 and operate the motors, 46 and 48, respectively, in equal and opposite directions of rotation to impart elliptical motion to the frame 12 of the assembly 10.

If the user elects to continue operation in step 310, then the user may change the mode of operation in step 312.

If the user elects to change the mode of operation from linear to elliptical in step 314, then the controller 210 may operate the forward motor starters, 202, 206, and 208, to operate the motor 30 and operate the motors, 46 and 48, respectively, in equal and opposite directions of rotation to impart elliptical motion to the frame 12 of the assembly 10 in step 316.

Alternatively, if the user elects to change the mode of operation from elliptical to linear in step 318, then the controller 210 may stop the operation of the forward motor starters, 206 and 208, to thereby stop the operation of the motors, 46 and 48, respectively, and stop the rotation of the motor 30 by stopping the operation of the forward motor starter 202 and operating the reverse motor starter 204 in step 320 to apply a reversing torque to thereby substantially stop the rotation of the motor 30 in step 320. After a predetermined time period has lapsed in step 322, after which the rotation of the motor 30 has substantially stopped, the controller 210 may then stop the operation of the reverse motor starter 204 and operate the forward motor starters, 206 and 208, to operate the motors, 46 and 48, respectively, in equal and opposite directions of rotation to impart linear motion to the frame 12 of the assembly 10 in step 324.

Thus, in the motion control program 300, changing the mode of operation from elliptical to linear is provided by momentarily reversing the direction of operation of the motor 30, and momentarily stopping the operation of the motors, 46 and 48. In this manner, the mechanical energy generated as a result of the rotation of the motors, 46 and 48, which would otherwise cause the motor 30 to continue rotating, is overcome. In an exemplary embodiment, the amount of time during which the rotation of the motors, 46 and 48, is stopped and the direction of operation of the motor 30 is reversed in steps 320 and 322 may be determined empirically. Furthermore, in an exemplary embodiment, the momentary reversal of the direction of rotation of the motor 30 in steps 320 and 322 momentarily applies a reversing voltage to the motor 30 which in turn applies a reversing torque upon the rotatable shaft 32 and the unbalanced weights, 34 and 36. As a result, in an exemplary embodiment, the rotation of the rotatable shaft 32 and the unbalanced weights, 34 and 36, is substantially stopped.

The present embodiments of the invention provide a number of advantages. For example, the ability to operate in a linear or an elliptical mode of operation without physical restructuring or mechanical reconfiguration of the assembly provides an efficient, reliable, and cost-effective system for providing both modes of operation.

It is understood that variations may be made in the foregoing without departing from the scope of the invention. For example, the actuators, 26, 38 and 40, for imparting motion to the frame 12 of the assembly 10 may include one or more unbalanced weights. Furthermore, the controllers 62 and 210 may include a programmable controller and/or hard wired control circuitry.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A separator for separating solids from liquids, comprising:

a frame;

a screen coupled to the frame;

means for moving the frame along a reciprocating linear path of travel;

means for moving the frame along an elliptical path of travel;

means for transitioning between moving the frame along the elliptical path of travel to the reciprocating path of travel.

2. The separator of claim 1, wherein the means for moving the frame along the reciprocating path of travel comprises:

first and second counter-rotating means.

3. The separator of claim 2, wherein the first and second counter-rotating means rotate at substantially equal speeds.

4. The separator of claim 2, wherein the first counter-rotating means includes a first unbalanced weight; and wherein the second counter-rotating means includes a second unbalanced weight.

5. The separator of claim 4, wherein the mass and the locations of the centers of mass of the first and second unbalanced weights are substantially equal.

6. The separator of claim 1, wherein the means for moving the frame along the elliptical path of travel comprises:

first and second counter-rotating means; and third rotating means.

7. The separator of claim 3, wherein the first and second counter-rotating means rotate at substantially equal speeds.

8. The separator of claim 3, wherein the first and second counter-rotating means includes a first unbalanced weight; and wherein the second counter-rotating means includes a second unbalanced weight.

9. The separator of claim 8, wherein the mass and the locations of the centers of mass of the first and second unbalanced weights are substantially equal.

10. The separator of claim 3, wherein the centers of rotation of the first and second counter-rotating means are normal to a common plane; and wherein the center of rotation of the third rotating means is not normal to the common plane.

11. The separator of claim 1, wherein the means for moving the frame along the reciprocating path of travel comprises first and second counter-rotating means; wherein the means for moving the frame along the elliptical path of travel comprises the first and second counter-rotating means and third rotating means; and wherein the means for transitioning between moving the frame along the elliptical path of travel to the reciprocating path of travel comprises means for momentarily stopping the operation of the first and second counter-rotating means and means for momentarily applying a reversing torque to the third rotating means.

12. A method of operating a separator including a screen coupled to a frame, comprising:

injecting a fluidic material including solids and liquids onto the screen;

moving the frame along a reciprocating linear path of travel in a first mode of operation;

moving the frame along an elliptical path in a second mode of operation, wherein moving the frame along the elliptical path comprises:

rotating a first unbalanced weight in a first direction about a first axis of rotation at a first speed;

rotating a second unbalanced weight in a second direction about a second axis of rotating at a second speed; and rotating a third unbalanced weight in a third direction about a third axis of rotation;

transitioning between moving the frame along the reciprocating linear path of travel and the elliptical path in a third mode of operation, wherein the first and second axes of rotation are normal to a different plane than the third axis of rotation.

13. A method of operating a separator including a screen coupled to a frame, comprising:

injecting a fluidic material including solids and liquids onto the screen;

moving the frame alone a reciprocating linear path of travel in a first mode of operation;

moving the frame along an elliptical path in a second mode of operation;

transitioning between moving the frame along the reciprocating linear path of travel and the elliptical path in a third mode of operation, wherein moving the frame along the reciprocating linear path of travel comprises rotating a first unbalanced weight in a first direction about a first axis of rotation at a first speed and rotating a second unbalanced weight in a second direction about a second axis of rotation at a second speed; wherein moving the frame along the elliptical path comprises rotating the first unbalanced weight in the first direction about the first axis of rotation at the first speed, rotating the second unbalanced weight in the second direction about the second axis of rotation at the second speed, and rotating a third unbalanced weight in a third direction about a third axis of rotation; and wherein transitioning between moving the frame along the elliptical path of travel to the reciprocating path of travel comprises momentarily stopping the rotation of the first and second unbalanced weights and momentarily applying a reversing torque to the third unbalanced weight.

14. A separator, comprising:

a frame;

a screen coupled to the frame;

an actuator for imparting linear motion to the frame coupled to the frame;

an actuator for imparting elliptical motion to the frame coupled to the frame; and a controller operably coupled to the actuator for imparting reciprocating linear motion to the frame and the actuator for imparting elliptical motion to the frame for controlling the operation of the actuator for imparting reciprocating linear motion to the frame and the actuator for imparting elliptical motion to the frame;

wherein the controller is programmed to operate in a first mode of operation in which the actuator for imparting reciprocating linear motion to the frame is operated;

wherein the controller is programmed to operate in a second mode of operation in which the actuator for imparting elliptical motion to the frame is operated; and wherein the controller is programmed to operate in a third mode of operation in which the actuator for imparting reciprocating linear motion is momentarily stopped and the actuator for imparting elliptical motion is momentarily reversed.

15. The separator of claim 14, wherein the actuator for imparting reciprocating linear motion to the frame comprises:

a first actuator comprising:

a first rotary motor having a first output shaft; and a first unbalanced weight coupled to the first output shaft; and a second actuator comprising:

a second rotary motor having a second output shaft; and a second unbalanced weight coupled to the second output shaft.

16. The separator of claim 15, wherein, in the first mode of operation, the controller is programmed to rotate the first output shaft in a first direction at a first speed and rotate the second output shaft in a second direction at a second speed.

17. The separator of claim 6, wherein the first and second directions are opposite; and wherein the first and second speeds are substantially equal.

18. The separator of claim 15, wherein the position of the centers of mass and the mass of the first and second unbalanced weights are substantially equal.

19. The separator of claim 15, wherein the first and second output shafts are normal to a common plane.

20. The separator of claim 14, wherein the actuator for imparting elliptical motion to the frame comprises:

a first actuator comprising:

a first rotary motor having a first output shaft; and a first unbalanced weight coupled to the first output shaft; and a second actuator comprising:

a second rotary motor having a second output shaft; and a second unbalanced weight coupled to the second output shaft; and a third actuator comprising:

a third rotary motor having a third output shaft; and a third unbalanced weight coupled to the third output shaft.

21. The separator of claim 20, wherein, in the second mode of operation, the controller is programmed to rotate the first output shaft in a first direction at a first speed, rotate the second output shaft in a second direction at a second speed, and rotate the third output shaft.

22. The separator of claim 21, wherein the first and second directions are opposite; and wherein the first and second speeds are substantially equal.

23. The separator of claim 20, wherein the position of the centers of mass and the mass of the first and second unbalanced weights are substantially equal.

24. The separator of claim 20, wherein the first and second output shafts are normal to a common plane.

25. The separator of claim 24, the third output shaft is not normal to the common plane.

26. A separator for separating liquids from solids, comprising:

a frame;

a screen coupled to the frame;

first and second counter-rotating means for moving the frame;

rotating means for moving the frame; and control means for operating the first and second counter-rotating means for moving the frame along a reciprocating linear path;

control means for operating the first and second counter-rotating means and the rotating means for moving the frame along an elliptical path;

control means for transitioning between operating the first and second counter-rotating means and the rotating means for moving the frame along the elliptical path and operating the first and second counter-rotating means for moving the frame along the reciprocating linear path.

27. A method of operating a separator including a screen coupled to a frame, comprising:

injecting a fluidic material including solids and liquids onto the screen;

moving the frame along a reciprocating linear path of travel in a first mode of operation by a method comprising:

rotating a first unbalanced weight in a first direction about a first axis of rotation at a first speed; and rotating a second unbalanced weight in a second direction about a second axis of rotation at a second speed;

wherein the locations of the centers of mass and the masses of the first and second unbalanced weights are substantially equal; and wherein the first and second speeds are equal; and wherein the first and second directions are opposite;

moving the frame along an elliptical path in a second mode of operation by a method comprising:

rotating the first unbalanced weight in the first direction about the first axis of rotation at the first speed;

rotating the second unbalanced weight in the second direction about the second axis of rotation at the second speed; and rotating a third unbalanced weight about a third axis of rotation;

wherein the first and second axis of rotation are normal to a common plane; and wherein the third axis of rotation is not normal to the common plane; and transitioning between moving the frame along the elliptical path in the second mode of operation to moving the frame along the reciprocating linear path of travel in the first mode of operation by a method comprising:

momentarily stopping the rotation of the first unbalanced weight in the first direction about the first axis of rotation at the first speed;

momentarily stopping the rotation of the second unbalanced weight in the second direction about the second axis of rotation at the second speed; and momentarily applying a reversing torque to the third unbalanced weight.

28. A separator, comprising:

a frame;

a screen coupled to the frame;

a linear actuator coupled to the frame comprising:

a first rotary motor coupled to the frame comprising a first rotatable shaft;

a first unbalanced weight coupled to the first rotatable shaft;

a second rotary motor coupled to the frame comprising a second rotatable shaft; and a second unbalanced weight coupled to the second rotatable shaft;

wherein the location of the centers of mass and the mass of the first and second unbalanced weights are substantially equal; and wherein the first and second rotatable shafts are substantially parallel and are normal to the same plane;

an elliptical actuator coupled to the frame comprising:

the linear actuator;

a third rotary motor coupled to the frame comprising a third rotatable shaft; and a third unbalanced weight coupled to the third rotatable shaft;

wherein the third rotatable shaft is not normal to the same plane as the first and second rotatable shafts; and a controller operably coupled to the linear and elliptical actuators for controlling the operation of the linear and elliptical actuators;

wherein the controller is programmed to operate in a first mode of operation in which the first and second rotatable shafts are rotated at substantially the same speed in opposite directions;

wherein the controller is programmed to operate in a second mode of operation in which the first and second rotatable shafts are rotated at substantially the same speed in opposite directions while the third rotatable shaft is rotated; and wherein the controller is programmed to operate in a third mode of operation in which the first and second rotatable shafts are momentarily stopped and a reversing torque is momentarily applied to the third rotatable shaft.

* * * * *

UNITED STATES PATENT AND TRADEMARK OFFICE

CERTIFICATE OF CORRECTION

PATENT NO. : 6,679,385 B2
DATED : January 20, 2004
INVENTOR(S) : Suter et al.

It is certified that error appears in the above-identified patent and that said Letters Patent is hereby corrected as shown below:

Column 5,
Line 41, delete “and second”

Column 6,
Line 9, delete “rotating” and insert -- rotation --
Line 22, delete “alone”and insert -- along --

Column 7,
Line 18, delete “6” and insert -- 16 --
Line 53, after “24,” insert -- wherein --

Signed and Sealed this

Twenty-seventh Day of April, 2004

JON W. DUDAS
*Acting Director of the United States Patent and Trademark Office*